US006432274B1

(12) United States Patent
Ödmark

(10) Patent No.: US 6,432,274 B1
(45) Date of Patent: Aug. 13, 2002

(54) DOCTOR ARRANGEMENT FOR ROLL PRESSES

(75) Inventor: Leif Ödmark, Matfors (SE)

(73) Assignee: Valmet Fibertech AB (SE)

( * ) Notice: Subject to any disclaimer, the term of this patent is extended or adjusted under 35 U.S.C. 154(b) by 0 days.

(21) Appl. No.: 09/806,017

(22) PCT Filed: Sep. 23, 1999

(86) PCT No.: PCT/SE99/01676

§ 371 (c)(1),
(2), (4) Date: Mar. 23, 2001

(87) PCT Pub. No.: WO00/17447

PCT Pub. Date: Mar. 30, 2000

(30) Foreign Application Priority Data

Sep. 24, 1998 (SE) ..... 9803248-5

(51) Int. Cl.[7] ..... D21F 7/00

(52) U.S. Cl. ..... 162/264; 162/261; 162/272; 15/256.51

(58) Field of Search ..... 162/56, 60, 199, 162/210, 221, 230, 261, 272, 274, 111, 281, 301, 302, 306, 308, 323, 358.1, 384; 100/37, 110, 121, 112, 174; 15/256, 51; 198/497, 498, 499; 210/326, 380, 391, 394, 396, 402

(56) References Cited

U.S. PATENT DOCUMENTS

| | | | | |
|---|---|---|---|---|
| 3,772,144 A | * | 11/1973 | Luthi et al. | 162/210 |
| 4,111,746 A | | 9/1978 | Biondetti | 162/272 |
| 4,206,528 A | * | 6/1980 | Klemz | 15/256.51 |
| 4,782,756 A | * | 11/1988 | Howard | 101/425 |
| 5,107,757 A | * | 4/1992 | Ohshita et al. | 100/90 |
| 5,868,903 A | * | 2/1999 | Petschauer et al. | 162/301 |

FOREIGN PATENT DOCUMENTS

| | | | |
|---|---|---|---|
| EP | 0 509 561 A2 | 10/1992 | B01D/33/09 |
| WO | 97/25475 | 7/1997 | D21G/3/00 |

* cited by examiner

*Primary Examiner*—Peter Chin
*Assistant Examiner*—Eric Hug
(74) *Attorney, Agent, or Firm*—Lerner, David, Littenberg, Krumholz & Mentlik, LLP

(57) ABSTRACT

Apparatus is disclosed for handling a web including a pair of juxtaposed press rolls providing a nip therebetween, a coarse shredder trough disposed above the nip to receive the web from the nip, and a doctor arrangement for transferring the web from the outer surfaces of the press roll including a doctor support extending longitudinally of the pair of press rolls and a plurality of doctor blades attached to the doctor supports and extending in abutment with the outer surfaces of the press rolls, the doctor arrangement being supported by the coarse shredder trough whereby the doctor blades form a rigid structure for the plurality of doctor blades.

7 Claims, 4 Drawing Sheets

DOCTOR ARRANGEMENT FOR ROLL PRESSES

FIELD OF THE INVENTION

The present invention relates to a doctor arrangement for roll presses which includes a web transfer device which lies against the barrel surfaces of each of the respective rolls or against a wire mounted on the barrel surface.

BACKGROUND OF THE INVENTION

A roll press generally includes two mutually coacting press rolls that define a press roll nip therebetween. The rolls are arranged in a trough into which a suspension of material, such as a pulp suspension, is delivered. The rolls have liquid pervious barrel surfaces and the suspension is de-watered by pressing the liquid through these surfaces with the aid of an overpressure. Final de-watering of the suspension to a desired dry content of the material is achieved in the nip between the rolls. The barrel surfaces of the press rolls comprise perforated sheet metal attached to a roll body. In order to obtain a sufficiently large capacity, the combined open area of the holes must be large while, at the same time, the holes must be small so that fibers will not accompany the liquid through the holes. Wires may be mounted onto the barrel surfaces of the rolls for this purpose. Downstream of the roll nip a doctor arrangement is located which functions to remove the de-watered pulp web from the rolls or from the wires mounted thereon. The doctor arrangement includes a web transfer device for each roll. In the past, the web transfer device has comprised a doctor beam that includes a doctor blade for abutment with the barrel surface of the roll or with the wire.

The present invention is based upon a problem which was encountered with doctor beams and doctor blades. This problem is one of maintaining the doctor blade and the wire surface at a particular distance apart, and is particularly manifested by the greater lengths of such roll presses. With the intention of obtaining maximum possible rigidity, the doctor beam has been provided with a box-like construction. The boxlike construction, coupled with the temperature differences of the different plates in the beam structure, make it impossible to retain the doctor blade setting. Consequently, the doctor blade has been placed firmly against the roll in practice, in order to reduce fiber transfer in the pulp. In the case of presses that do not include wires, this practice has been more or less successful, and results in lower fiber transfer. In the case of rolls that are fitted with wires, however, it has not been possible to adjust the doctor blade to a zero setting without the risk of cutting the wire to pieces.

An object of the present invention is to thus eliminate the aforesaid problem and to enable the doctor blades to optimally abut the press rolls.

SUMMARY OF THE INVENTION

In accordance with the present invention, this and other objects have now been realized by the invention of apparatus for handling a web comprising a pair of juxtaposed press rolls including an outer surface and providing a nip therebetween for providing the web, a coarse shredder trough disposed above the nip for receiving the web from the nip, web transfer means for transferring the web from the outer surfaces of the pair of juxtaposed press rolls, and web transfer means comprising a plurality of doctor sections extending longitudinally of the pair of juxtaposed press rolls and a plurality of doctor blades attached to the plurality of doctor sections and extending in abutment with the outer surfaces of the pair of juxtaposed press rolls, the web transfer means being supported by the coarse shredder trough by a pair of adjustable support members and a pair of pivot shafts for pivotable movement of said pair of adjustable members. In accordance with a preferred embodiment, the outer surfaces of the pair of juxtaposed press rolls comprise wire means mounted on the outer surface of the pair of juxtaposed press rolls.

In another embodiment, the pair of adjustable support members comprises a pair of bottle screws.

In accordance with one embodiment of the apparatus of the present invention, the pair of adjustable support members comprises spring means for resiliently mounting the pair of doctor sections relative to the outer surface of the pair of juxtaposed press rolls. In a preferred embodiment, the spring means are adjustable into a rigid position with respect to the outer surface of the pair of juxtaposed press rolls.

In accordance with another embodiment of the apparatus of the present invention, the apparatus includes suspension means connecting the coarse shredder trough with the plurality of doctor sections at the intersection of the plurality of doctor sections, the suspension means also connecting the plurality of doctor sections together at the intersection. Preferably, the suspension means is eccentrically pivotably connected to the plurality of doctor sections.

BRIEF DESCRIPTION OF THE DRAWINGS

The present invention will now be described in more detail with reference to the following detailed description which, in turn, refers to the accompanying drawings, in which.

DETAILED DESCRIPTION

Figure 1:
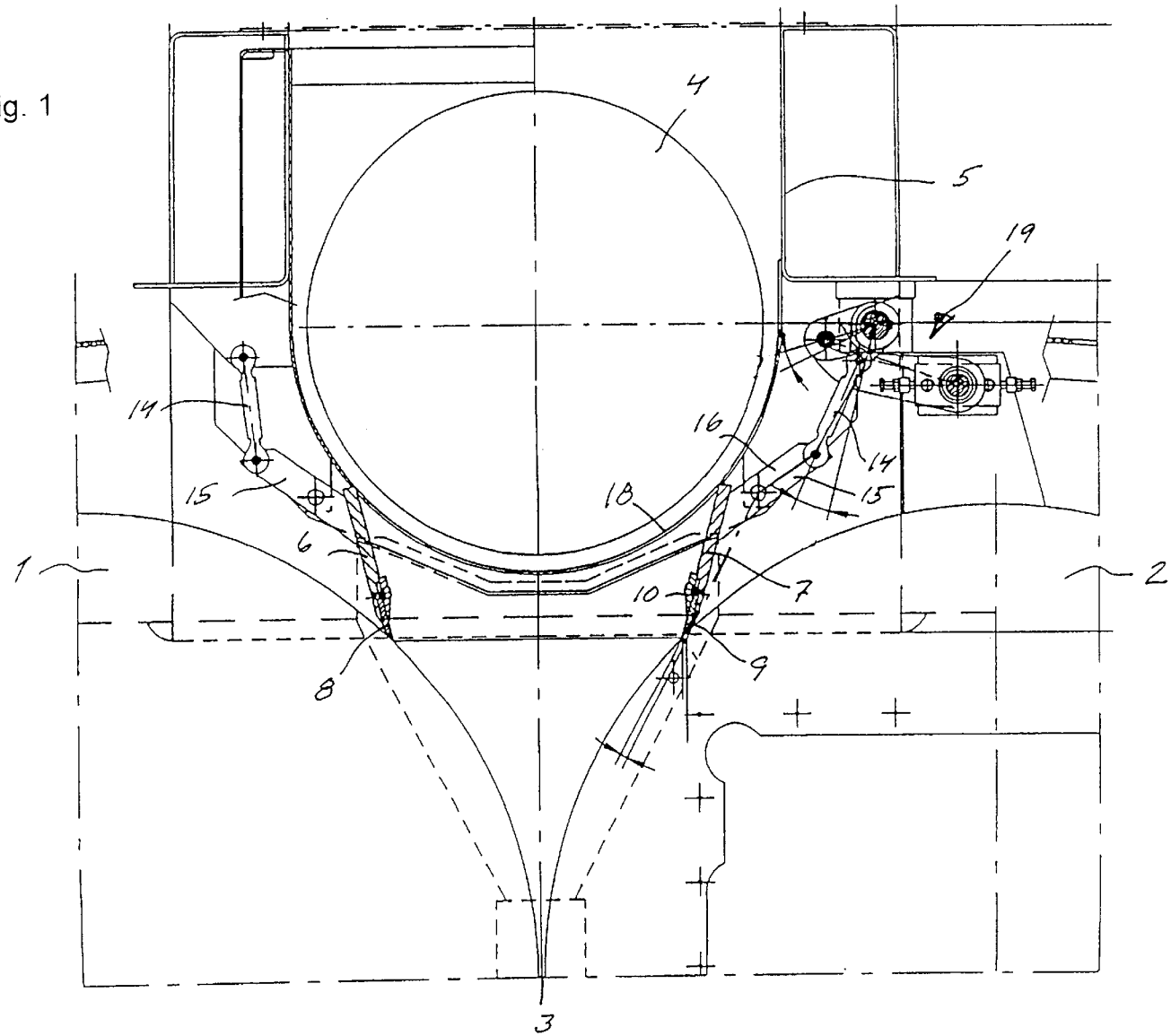
FIG. 1 is a side, elevational, cross-sectional view of the central part of a roll press equipped with a doctor arrangement above the roll nip in accordance with the present invention.

The roll press illustrated in FIG. 1 includes two rolls, 1 and 2, which includes a perforated barrel, and which can also include a wire for allowing water pressed from the pulp to pass through. The roll 2 of rolls 1 and 2 can be moved laterally to adjust the setting of the roll nip 3. The pulp is pressed upwardly towards the nip 3 between the rolls, 1 and 2, where the pulp is de-watered, and is then pressed up from the nip 3 against a shredder screw 4 arranged in a coarse shredder trough 5 and extending parallel with the rolls. The shredder screw 4 disintegrates the pulp and conveys it axially out of the press. Each roll, 1 and 2, is equipped with a respective web transfer device, 6 and 7. The web transfer devices, 6 and 7, are comprised of doctor sections 13 forming part of a modular system. Doctor blades 8 and 9 are provided at the bottom of respective doctor sections, for scraping respective roll surfaces or wire surfaces.

Figure 2:
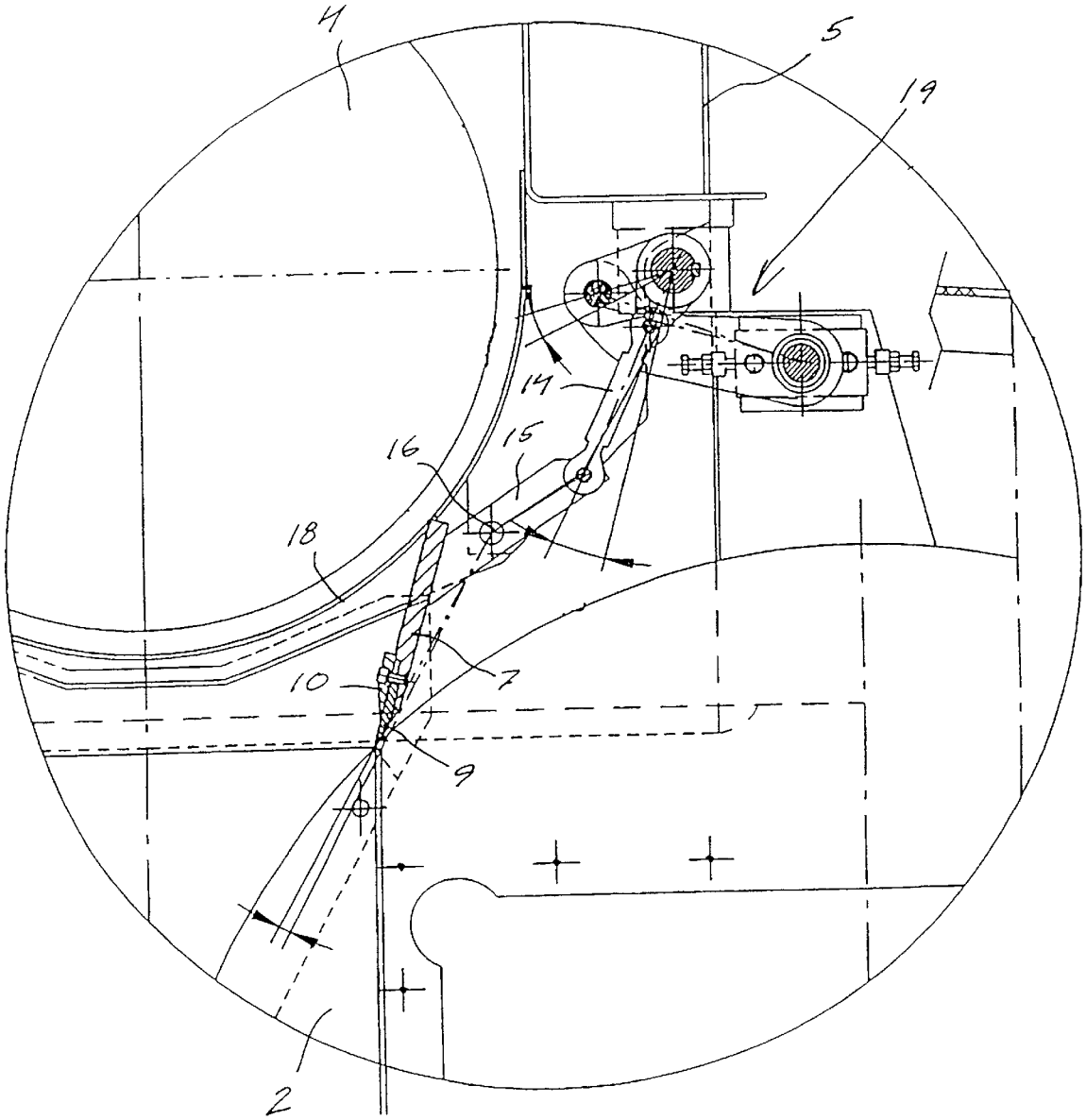
FIG. 2 is a side, elevational, enlarged view of a portion of the apparatus shown in FIG. 1.

FIG. 2 is an enlarged view of that portion of the doctor arrangement belonging to the moveable roll 2. Each doctor blade 9 is carried in the web transfer device 7 by a clamping strip 10. Division of the web transfer device, doctor blades and clamping strips into modules 13 in the longitudinal direction of the press will best be seen from FIG. 3. The doctor sections 13 are carried by the coarse shredder trough 5 by means of supports 14, which in the case of the illustrated embodiment have the form of bottlescrews. As will be seen from FIGS. 2 and 3, a support element 14 is provided for each section 13. Each support element 14 is pivotally mounted to an arm 15 fixed to the module 13, and each arm is, in turn, pivotally mounted on a pivot shaft 16. Because the doctor sections are pivotal about the pivot shaft 16, the doctor blades, 8 and 9, can be pressed against their respective roll surface, 1 and 2, with an appropriate force, by shortening the support element 14. That part of the doctor arrangement belonging to the moveable roll 2 includes a setting device 19 on each support element 14, for changing the position of the support mounting at the coarse shredder trough 5. This enables the individual modules to follow the moveable roll.

Figure 3:
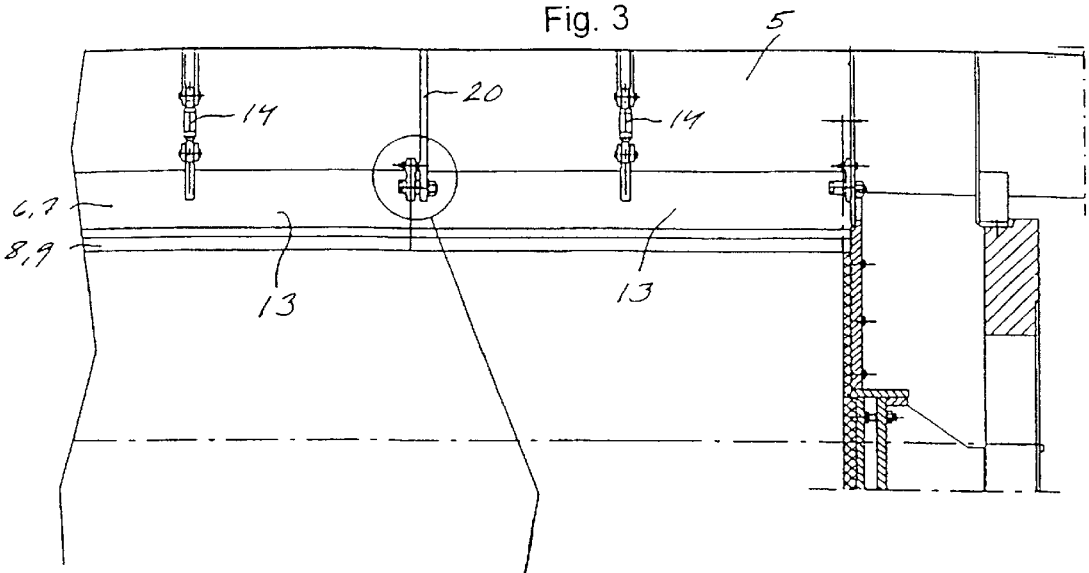
FIG. 3 is a front, elevational view of a web transfer device in accordance with the present invention in a longitudinal plane through the press.
Figure 3A:
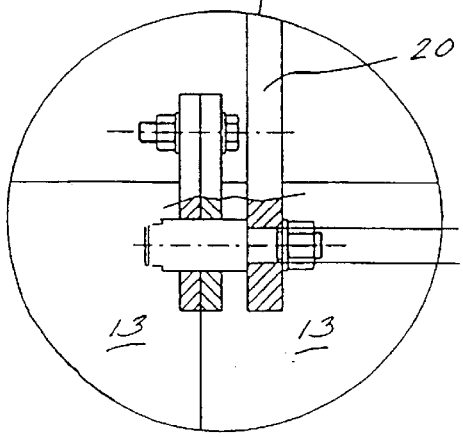
FIG. 3*a* is a front, elevational, enlarged view of a portion of the apparatus shown in FIG. 3.
Figure 3B:
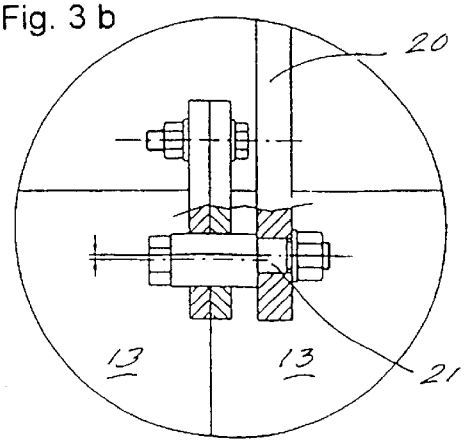
FIG. 3*b* is a front, elevational, enlarged view of another embodiment of a portion of the apparatus shown in FIG. 3.
Figure 3C:
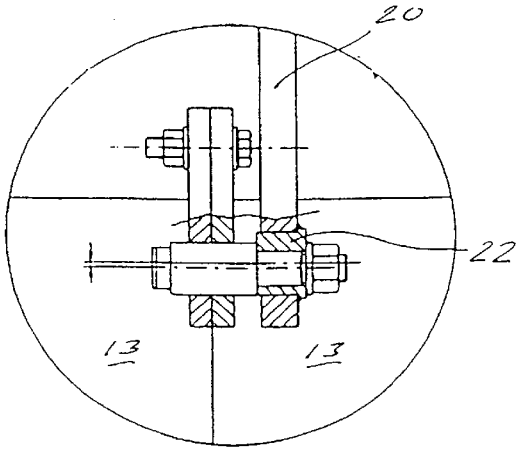
FIG. 3*c* is a front, elevational, enlarged view of another embodiment of a large portion of the apparatus shown in FIG. 3.

Also shown in FIG. 3 is a suspension device 20 provided at the boundary between two doctor sections 13 to thus connect the sections 13 end-to-end. The suspension can be made eccentric in accordance with FIG. 3*b* with the aid of an eccentric pin 21, or eccentric in accordance with FIG. 3*c* with an eccentric sleeve 22, 50 that adjustments can be made to the suspension points of the modules when necessary.

Figure 4:
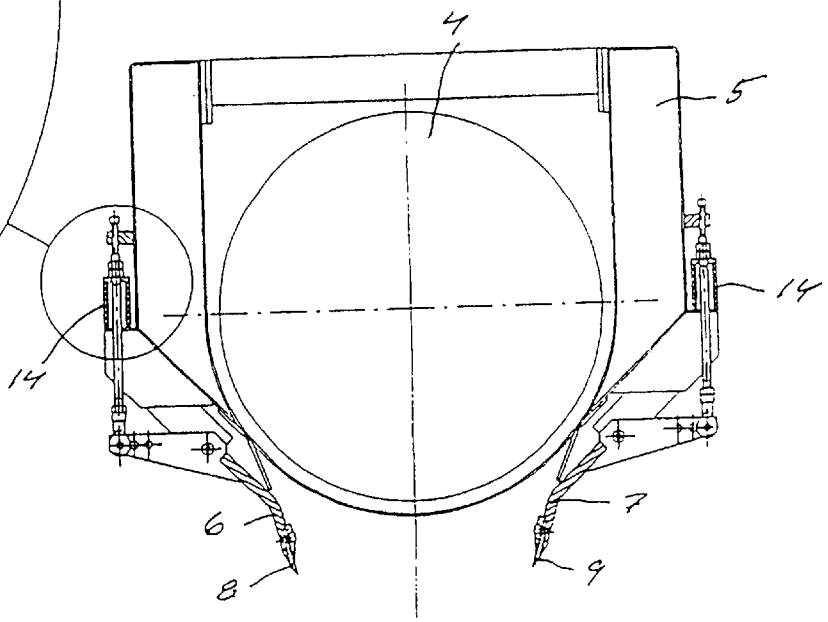
FIG. 4 is a side, elevational, cross-sectional view of another embodiment of a doctor arrangement according to the present invention.
Figure 4A:
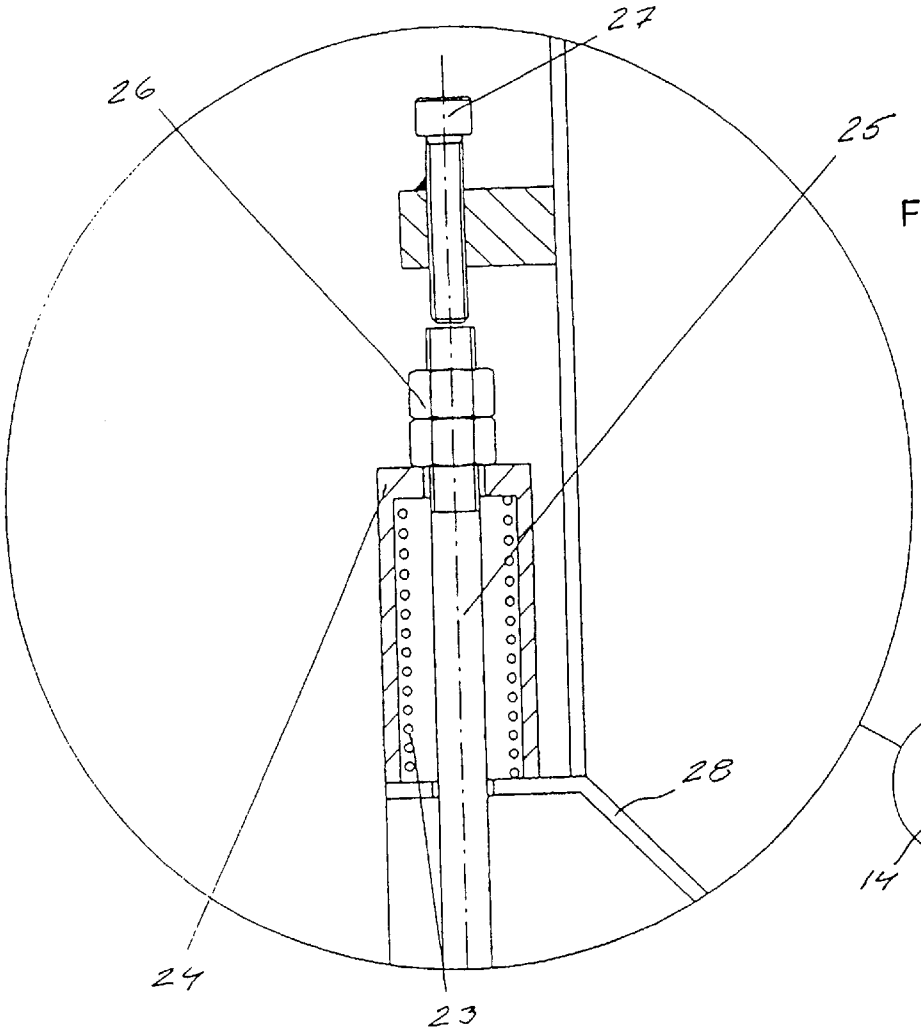
FIG. 4*a* is a front, elevational, enlarged view of a portion of the apparatus shown in FIG. 4.

FIGS. 4 and 4*a* illustrate an alternative embodiment of the supports 14. In the case of this embodiment, instead of a bottle screw there is used, for example, a spring device that includes a compression spring 23 housed in a sleeve 24. A setting rod 25 is connected to the sleeve 24 and loads the spring 23 downward in FIG. 4*a* to an extent which depends on the position of the setting nut 26. Upward movement of the setting rod 25 is limited by a stop screw 27. This arrangement enables the doctor beam to be set positionally in four different ways. When the setting rod 25 is spaced from the stop screw 27 there will be spring abutment with the roll, and when the sleeve 24 is spaced from the trough plate 28, i.e. the resting surface of the spring, the doctor beam can be moved away from the roll. On the other hand, in the absence of any space between the setting rod 25 and the stop screw 27, there will be no spring abutment with the roll and if there is no distance between the sleeve 24 and the trough plate 28, there will be no movement of the doctor beam away from the roll. This arrangement thus allows the support element 14 to operate in any one of four different ways, namely fully resilient, i.e. movement in both directions is permitted, resiliency against the roll, i.e. only movement towards the roll is permitted, resiliency away from the roll, i.e. movement is only permitted away from the roll, and full rigidity, i.e. no movement is permitted either towards or away from the roll.

The coarse shredder trough, which has previously been used solely to transport pulp, is also now used in accordance with the present invention as a reference point for the doctor sections. The coarse shredder trough already has the form of a beam construction, and the additional use of the trough to suspend the doctor sections means that the trough must be strengthened with stronger side-beams. The trough 5 thus becomes the rigid part, and transfer of the web is effected by doctor sections that are suspended individually from the trough 5. The modular construction also enables the doctor arrangement to be used with presses of mutually different sizes, where the number of presses is the sole parameter. Because the doctor sections are thus short and constructed from a single plate, the temperature problems existing with traditional box constructions no longer occur. The doctor construction can be given any length along the press and no interspaces need be provided in order to compensate for thermal expansion. The system of modules means that each web transfer device will be thin but nevertheless strong, and will provide better geometrical conditions with respect to the roll body, i.e. provide better clearance angles to the roll, therewith reducing the risk of pulp packing beneath the doctor blades.

The doctor arrangement of the present invention thus provides significant improvement to the longest presses. The doctor beams previously used have required a center support fastened in the press trough. This construction required the press trough to be made stronger so as to prevent outward deflection of the press trough as a result of the trough pressure affecting the center support, i.e. the center of the doctor beam, thus causing the doctor blade to penetrate into the roll. Since this support can now be eliminated, the press trough can be calculated for a different outward deflection of the trough and is not restricted by the position or attitude of the doctor blade relative to the roll.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for handling a web comprising a pair of juxtaposed press rolls including an outer surface and providing a nip therebetween for providing said web, a coarse shredder trough disposed above said nip for receiving said web from said nip, web transfer means for transferring said web from said outer surfaces of said pair of juxtaposed press rolls, said web transfer means comprising a plurality of doctor sections extending longitudinally of said pair of juxtaposed press rolls and a plurality of doctor blades attached to said plurality of doctor sections and extending in abutment with said outer surfaces of said pair of juxtaposed press rolls, a pair of adjustable support members connecting said plurality of doctor sections to said coarse shredding trough, whereby said plurality of doctor sections have a rigid structure for said plurality of doctor blades, and a pair of pivot shafts for pivotable movement of said pair of adjustable support members.

2. The apparatus of claim 1 wherein said outer surfaces of said pair of juxtaposed press rolls comprise wire means mounted on said outer surface of said pair of juxtaposed press rolls.

3. The apparatus of claim 1 wherein said pair of adjustable support members comprises a pair of bottle screws.

4. The apparatus of claim 1 wherein said pair of adjustable support members comprises spring means for resiliently mounting said pair of doctor sections relative to said outer surface of said pair of juxtaposed press rolls.

5. The apparatus of claim 4 wherein said spring means are adjustable into a rigid position with respect to said outer surface of said pair of juxtaposed press rolls.

6. The apparatus of claim 1 including suspension means connecting said coarse shredder trough with said plurality of doctor sections at the intersection of said plurality of doctor sections, said suspension means also connecting said plurality of doctor sections together at said intersection.

7. The apparatus of claim 6 wherein said suspension means is eccentrically pivotably connected to said plurality of doctor sections.

* * * * *